US011913162B2

(12) United States Patent
Brisjö et al.

(10) Patent No.: US 11,913,162 B2
(45) Date of Patent: Feb. 27, 2024

(54) TUMBLE DRYER

(71) Applicant: Electrolux Professional AB (publ), Stockholm (SE)

(72) Inventors: Johan Brisjö, Stockholm (SE); Martin Nilsson, Stockholm (SE); Gunnar Ingemar Persson, Stockholm (SE)

(73) Assignee: Electrolux Professional AB (Publ), Stockholm (SE)

( * ) Notice: Subject to any disclaimer, the term of this patent is extended or adjusted under 35 U.S.C. 154(b) by 772 days.

(21) Appl. No.: 16/766,799

(22) PCT Filed: Nov. 28, 2017

(86) PCT No.: PCT/EP2017/080657
§ 371 (c)(1),
(2) Date: May 26, 2020

(87) PCT Pub. No.: WO2019/105526
PCT Pub. Date: Jun. 6, 2019

(65) Prior Publication Data

US 2021/0010195 A1 Jan. 14, 2021

(51) Int. Cl.
*D06F 58/20* (2006.01)
*D06F 58/04* (2006.01)
(Continued)

(52) U.S. Cl.
CPC ..... *D06F 58/206* (2013.01); *D06F 58/04* (2013.01); *D06F 58/20* (2013.01);
(Continued)

(58) Field of Classification Search
CPC ..... D06F 58/206; D06F 58/04; D06F 58/20; D06F 2103/40; D06F 2103/50; D06F 2105/26
See application file for complete search history.

(56) References Cited

U.S. PATENT DOCUMENTS 3,132,490 A * 5/1964 Schmidt ..... F25B 13/00 62/81
2005/0198852 A1* 9/2005 Ono ..... D06F 58/20 34/604

(Continued)

FOREIGN PATENT DOCUMENTS

CN 1906451 1/2007
CN 102482823 5/2012

(Continued)

OTHER PUBLICATIONS

European Communication for application No. 17805188.4 dated Nov. 16, 2022, 5 pages.

(Continued)

*Primary Examiner* — Edelmira Bosques
*Assistant Examiner* — Bao D Nguyen
(74) *Attorney, Agent, or Firm* — Pearne & Gordon LLP

(57) ABSTRACT

The present disclosure relates to a tumble dryer 1 with a rotatable drum 11 and a heat pump for drying process air that enters the drum, the heat pump comprising a condenser 19, a compressor 17, and an evaporator 15. In order to improve energy efficiency, the rotatable drum comprises a circular rear wall with air inlet openings and a radial cylindrical wall with air outlet openings, the compressor 17 is adapted to be run by an inverter 29, allowing the compressor output to be varied, and the expansion 16 is controllable. This allows the heat pump arrangement to be controlled to an optimum heat pump cycle envelope.

19 Claims, 4 Drawing Sheets

(51) Int. Cl.
*D06F 103/40* (2020.01)
*D06F 103/50* (2020.01)
*D06F 105/26* (2020.01)

(52) U.S. Cl.
CPC ..... *D06F 2103/40* (2020.02); *D06F 2103/50* (2020.02); *D06F 2105/26* (2020.02)

(56) References Cited

U.S. PATENT DOCUMENTS

| | | | | |
|---|---|---|---|---|
| 2009/0090118 | A1 | 4/2009 | Pham et al. | |
| 2009/0211309 | A1* | 8/2009 | Kawabata | D06F 25/00 68/20 |
| 2012/0186305 | A1 | 7/2012 | Taniguchi et al. | |
| 2012/0210597 | A1 | 8/2012 | Bison et al. | |
| 2015/0121718 | A1* | 5/2015 | Huang | D06F 58/206 34/524 |

FOREIGN PATENT DOCUMENTS

| | | | | |
|---|---|---|---|---|
| CN | 107385829 | | 11/2017 | |
| DE | 19642164 | | 4/1998 | |
| DE | 102012212159 | | 1/2014 | |
| EP | 2489775 | | 8/2012 | |
| EP | 2650425 | A1 * | 10/2013 | D06F 58/206 |
| EP | 2733254 | | 5/2014 | |
| EP | 3246458 | | 11/2017 | |
| EP | 3246458 | A1 * | 11/2017 | A47B 61/00 |
| JP | S5989973 | | 5/1984 | |
| JP | H07178289 | | 7/1995 | |
| JP | H09292135 | | 11/1997 | |
| JP | H11034634 | | 2/1999 | |
| JP | 2001066019 | | 3/2001 | |
| JP | 2001251078 | | 9/2001 | |
| JP | 2004239463 | | 8/2004 | |
| JP | 2005-42975 | A * | 2/2005 | |
| JP | 2005101349 | | 4/2005 | |
| JP | 2005224492 | | 8/2005 | |
| JP | 2006150095 | | 6/2006 | |
| JP | 2006230887 | | 9/2006 | |
| JP | 2007068871 | | 3/2007 | |
| JP | 2007135958 | | 6/2007 | |
| JP | 2009028112 | | 2/2009 | |
| JP | 2009060991 | | 3/2009 | |
| JP | 2010012074 | | 1/2010 | |
| JP | 2013178014 | | 9/2013 | |
| JP | 2016123770 | | 7/2016 | |
| JP | 2016220743 | | 12/2016 | |
| JP | 2017080009 | | 5/2017 | |
| WO | 2016204415 | | 12/2016 | |

OTHER PUBLICATIONS

International Search Report and Written Opinion for PCT/EP2017/080657, dated Sep. 14, 2018, 13 pages.
Chinese Office action (and English translation) for application No. 201780097249.0 dated Nov. 17, 2022, 23 pages.
Notice of Refusal for Japanese application No. 2020-529149 dated Dec. 21, 2021, 10 pages.

* cited by examiner

TUMBLE DRYER

FIELD OF THE INVENTION

The present disclosure relates to a tumble dryer comprising a housing, a drum in the housing being accessible from a front side of the housing and being rotatable about its center axis, a fan arrangement for producing a flow of process air passing through the drum, and a heat pump for drying the process air before entering the drum, the heat pump comprising a compressor, a condenser, an expansion valve, and an evaporator forming a refrigerant fluid loop.

TECHNICAL BACKGROUND

Such a tumble dryer is shown for instance in EP-3118365-A1, one problem with such tumble dryers is how to improve their energy efficiency further.

SUMMARY OF THE INVENTION

One object of the present disclosure is therefore to provide a tumble dryer with improved efficiency. This object is achieved by means of a tumble dryer as defined in claim 1. More specifically, the rotatable drum comprises a circular rear wall with air inlet openings and a radial cylindrical wall with air outlet openings, and the compressor is adapted to be run by an inverter, allowing the compressor output to be varied. The expansion valve is also controllable. With such a configuration, a high process air flow can be maintained through the drum, even if a front door of the dryer is opened. At the same time, the compressor and the expansion valve can be controlled to provide a heat pump effect that varies depending on the circumstances to provide improved efficiency.

The evaporator may comprise a flow divider, dividing a refrigerant fluid flow into a plurality of sub-flows for different portions of the evaporator. The controllable expansion valve may be attached to the flow divider. A close connection between the expansion valve and the flow divider provides a more laminar flow achieving an equal division of the refrigerant into the different sub-flows. This in turn provides a more efficient evaporator.

The conduit between the expansion valve and the flow divider may be straight, and may preferably have a length less than 100 mm.

The expansion valve and the compressor may be controlled by means of a controller based on sensor data from a first and a second pressure sensor and a first and a second temperature sensor. The first pressure sensor and the first temperature sensor may be located in the refrigerant fluid flow from the expansion valve to the compressor, while the second pressure sensor and the second temperature sensor may be located in the refrigerant fluid flow from the compressor to the expansion valve. With such a sensor configuration, the controller has knowledge of both the high and low temperatures and pressures of the heat pump circuit, and can therefore control the heat pump to a desired heat pump cycle envelope. This enables a heat pump operation with improved efficiency.

There may be provided a threaded connection adapted to receive a replacement sensor in each of the heat pump circuit path from the expansion valve to the compressor, and/or from the compressor to the expansion valve. This allows a malfunctioning pressure or temperature sensor to be replaced without physically removing the faulty sensor and possibly without removing most of the refrigerant in the heat pump circuit. Instead, a replacement sensor is simply fitted at the threaded connection to record temperature or pressure data.

The inverter may comprise a heatsink cooled by heat pump flow which provides efficient cooling of the inverter electronics and reuses some of the dissipated energy in the heat pump drying process.

In a first example, the heat pump flow may be a refrigerant flow, where the heat sink is cooled by a suction line between the evaporator and the compressor. Then, a loop of the suction line may be embedded in the heat sink. The heat pump circuit may be enclosed in an insulating shell, and the suction line may reach out of the insulating shell to reach the heat sink.

In another example, the heat pump flow may be a process air flow, the heat sink being cooled by the process air flow leaving the evaporator. The heat pump circuit may be enclosed in an insulating shell and the heat sink may reach to the inside of the shell. The inverter electronics may be located in the comparatively dryer environment outside the shell.

The drum in the tumble dryer is accessible through a door, and control of the compressor may be adapted to keep the refrigerant flow on, i.e. the compressor switched on when the door is opened, while only reducing the refrigerant flow. This implies fewer start/stop cycles of the compressor if the door e.g. is opened frequently to add or remove laundry. The refrigerant flow may however be reduced to 30-60% of the flow before the door was opened. When the door has been open a predetermined period of time, e.g. one minute, the compressor may subsequently be switched off.

The heat pump may be enclosed in an insulating shell and there may be provided an opening in the shell between the condenser and the inlet of the drum. This serves to avoid overpressure in the drum that could cause hot and humid air to be pressed into spaces containing electronics and the like, which should be avoided. There may be provided a corresponding opening in the outer housing.

The space outside the drum's cylindrical periphery may be configured as a duct leading to a filter. This may provide a considerable flow area with a comparatively small restriction of the air flow, which may allow for a high capacity.

A filter for removing lint from the air flow may be located below the drum. This allows the use of a large filter, substantially as wide as the cylindrical diameter of the drum, and as deep as the depth of the drum. This provides a relatively small flow restriction.

DETAILED DESCRIPTION

Figure 1:
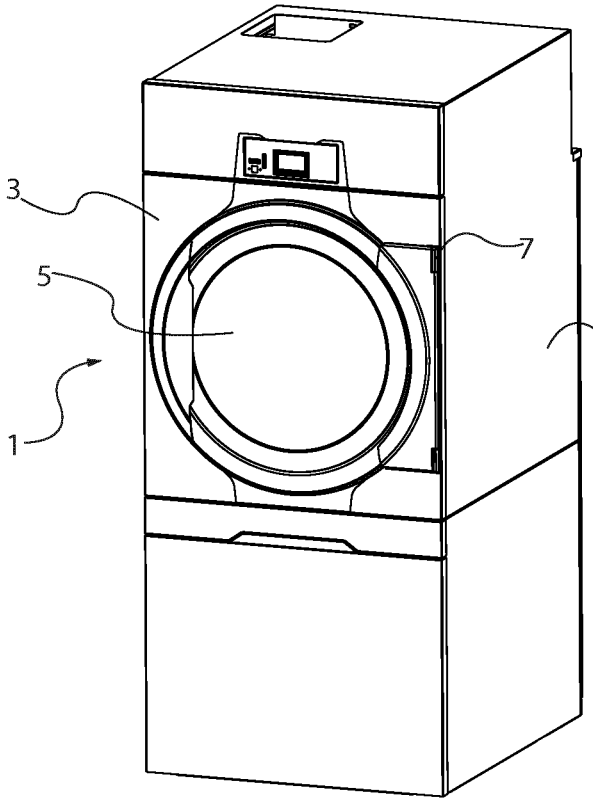
FIG. 1 shows a perspective view of a tumble dryer.

The present disclosure relates generally to a tumble dryer which is provided with a heat pump in order to achieve energy-efficient drying of laundry. An example of a tumble dryer 1 is illustrated in FIG. 1. The tumble dryer 1 has a housing 2 with a front side 3 which is provided with a door 5 or hatch, attached to the front side 3 with hinges 7, which provides access to a tumble dryer drum where wet laundry can be loaded.

Figure 2:
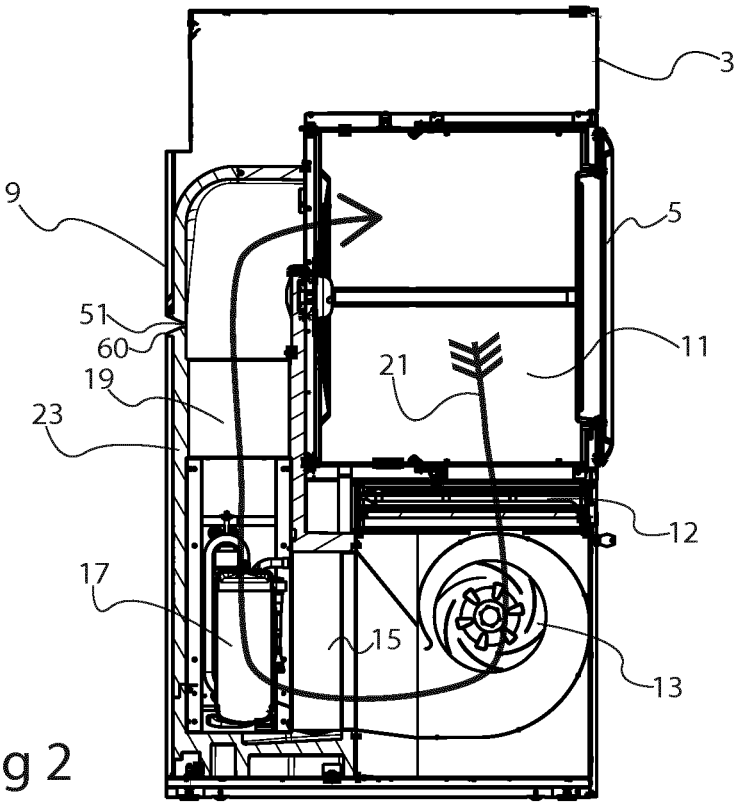
FIG. 2 illustrates a cross section through a tumble dryer with a heat pump arrangement.

FIG. 2 illustrates a cross section through a tumble dryer with a heat pump arrangement. In a heat pump tumble dryer, process air drying the laundry can circulate mostly within the outer enclosure of the tumble dryer, although some exchange of air with the outside may be allowed as will be shown. FIG. 2 illustrates in a cross section, components of such a tumble dryer as well as a process air flow path 21. As mentioned, the tumble dryer comprises a drum 11 in which wet laundry is placed. While the drum 11 rotates, a flow 21 of relatively dry process air is fed therethrough. The flow is provided by a fan 13 or blower, which in the illustrated case is located in a space below the drum 11.

Figure 3:
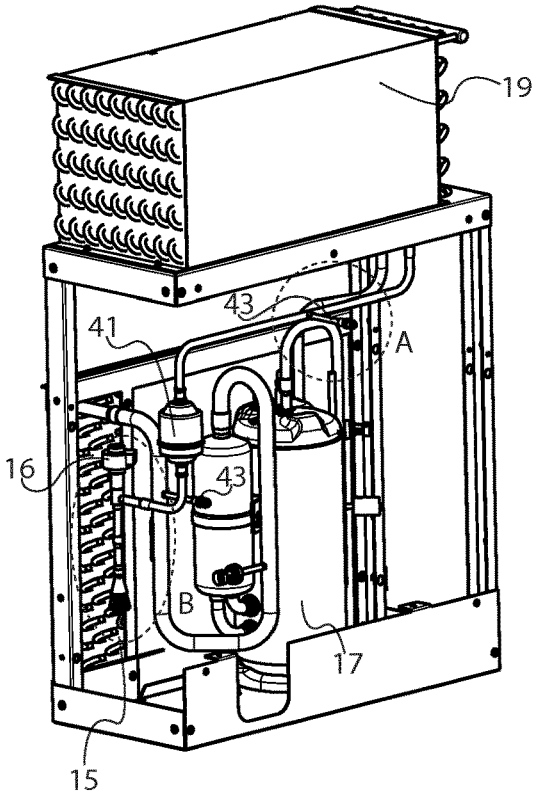
FIG. 3 shows a perspective view of the heat pump arrangement of the tumble dryer in FIG. 2.

The tumble dryer includes a heat pump arrangement with an evaporator 15, a compressor 17, a condenser 19, and an expansion valve 16 (cf. FIG. 3). A refrigerant medium is forced through the heat pump arrangement by the compressor 17, and gathers energy in the evaporator 15 which is released in the condenser 19, as is well known per se.

As illustrated in FIG. 2, an air flow 21 is achieved where hot, humid air is extracted from the perforated drum 11 by means of the fan 13. The air flow passes a filter 12 before reaching the fan 13 and arrives at the evaporator 15, which cools the air flow such that moisture therein condenses into liquid water. This water is collected in the bottom section of the tumble dryer and may be drained therefrom through a tube (not shown). A compressor 17 is provided to obtain the heat pump refrigerant flow.

The process air flow 21, which is now cooler and contains less water, is passed to the rear section of the tumble dryer and subsequently passes the condenser 19, which heats the air again. Then, the heated, dry air is reintroduced into the drum 11 where it is again capable of absorbing water from the laundry therein. The heat pump may be enclosed in an insulating shell 23, for instance made of expanded propylene, EPP. This improves the energy efficiency of the tumble dryer, as less heat may leak to the ambient space.

The present tumble dryer involves a number of improvements, for instance providing increased energy-efficiency and/or capacity. In the illustrated examples, a high-capacity tumble dryer mainly intended for professional use or for use in shared laundry facilities is shown. Such tumble dryers may comprise a drum 11 with air inlet openings in its circular rear wall and air outlet openings in its radial cylindrical wall, particularly in the front part thereof, to provide a process air flow through the drum. This may be combined with a lint removing filter 12 located below the drum, rather than with a filter provided outlet located in connection with the front wall door 5. To a great extent however, the improvements described herein may also be used in connection with typical domestic tumble dryers intended for use a couple of times per week.

Figure 4:
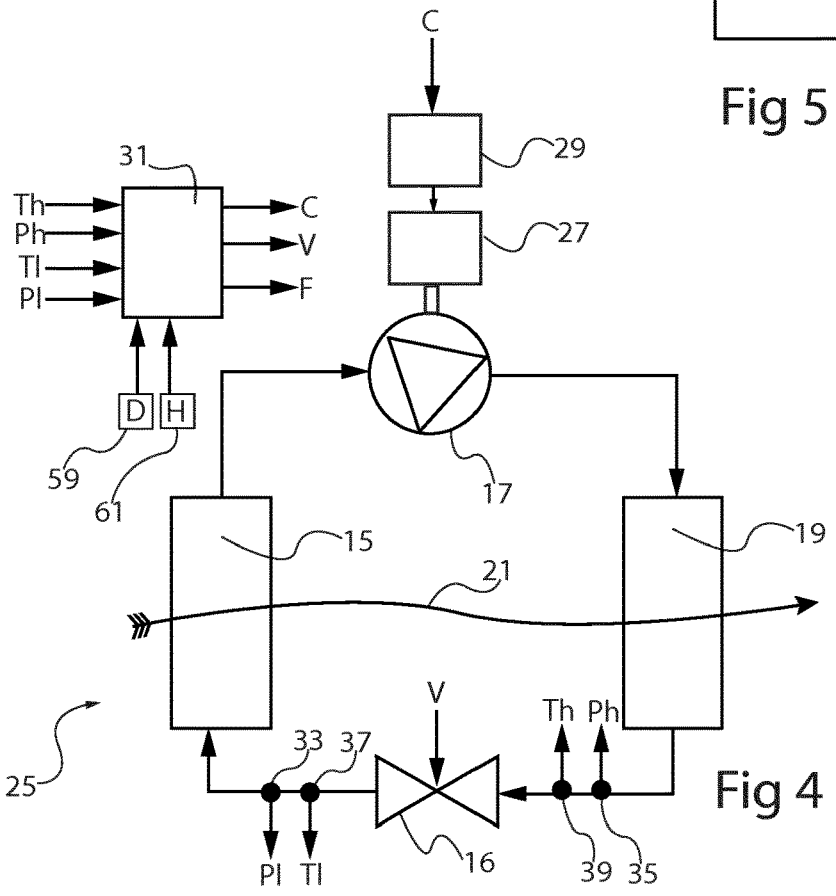
FIG. 4 illustrates schematically the heat pump circuit of FIG. 3.

FIG. 3 shows a perspective view of the heat pump arrangement of the tumble dryer in FIG. 2, and FIG. 4 illustrates schematically the heat pump circuit 25 of the heat pump in FIG. 3. In this example, the compressor 17 is adapted to be run by an inverter-controlled motor 27. An inverter 29 is provided allowing the compressor 17 output to be varied. This is in contrast to systems where compressors are merely switched on and off to control their operation. Further, the expansion valve 16 is controllable, typically being an electronic expansion valve, EEV.

The compressor 17 and the expansion valve 16 are controlled by a controller 31, based on a number of inputs. A control signal C for the compressor 17, and a control signal V for the expansion valve 16 are thus provided.

The heat pump circuit 25 may comprise a first 33 and a second 35 pressure sensor and a first 37 and a second 39 temperature sensor. The first pressure sensor 33 and the first temperature sensor 37 are located in the refrigerant fluid flow from the expansion valve 16 to the compressor 17, i.e. in the cold side of the circuit. The second pressure sensor 35 and the second temperature sensor 37 are located in the refrigerant fluid flow from the compressor 17 to the expansion valve 16, i.e. in the hot side of the circuit 25.

Figure 5:
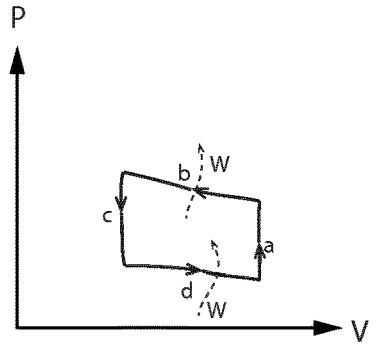
FIG. 5 illustrates an operation cycle.

This allows the heat pump arrangement to be controlled e.g. for optimal energy efficiency. FIG. 5 schematically illustrates an operation cycle where the refrigerant fluid is affected by the compressor, a, condenser, b, the expansion valve, c, and the evaporator, d, while energy W is taken away from and moved back to the process air flow 21, cf. FIG. 5. With knowledge of the high and low temperatures as well as the high and low pressures of the cycle optimal control of the operation cycle envelope indicated in FIG. 5 depending on circumstances may be achieved. This may imply providing a maximum output as well as reducing the same. Typically, the expansion valve is controlled to match the compressor output. For example, when during a drying process the air flow begins to become dryer, less energy is retrieved from the flow when leaving the drum. This can be sensed by the controller that reduces the compressor rpm correspondingly. As a result, the compressor uses less power and losses need to be cooled to a lesser extent. A significant amount of energy can be saved this way.

Further, if the door 5 is opened, which may be sensed by a door sensor/switch 59 (cf. FIG. 4), the compressor 17 output may be reduced, although it may be advantageous to run the compressor 17 rather than switching it off completely. For example, the compressor output may be reduced to 30-60% of the output before the door was opened, in terms of compressor rpm. Typically, the compressor 17 may go from 110 to 50 Hz when the door is opened. This may for instance improve the durability of the compressor as the number of start/stop cycles during normal use can be reduced.

When the door is opened, the rotation of the drum however may stop completely. The process air flow can nevertheless be maintained.

When the door has been open for a predetermined period of time, the compressor 17 is switched off as is the fan arrangement 13.

It is also possible to control the heat pump circuit 25 based on e.g. a sensed humidity from a humidity sensor 61 in the process air stream 21 when leaving the drum 11. This allows for instance leaving a residual humidity in the laundry that may be preferred in some types of fabric. It is also possible to achieve a process cycle with a predefined maximum process air temperature, which may be preferred for other fabrics.

Figure 6:
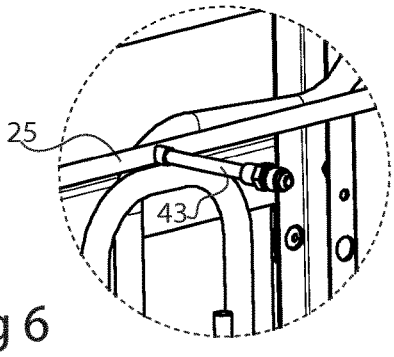
FIG. 6 shows enlarged a portion A of FIG. 3.

FIG. 6 shows enlarged a portion A of FIG. 3 where a part of the heat pump circuit is shown, namely leading from the condenser 19 to the expansion valve 16 and via a filter 41. As shown in FIG. 6, there is provided a connection 43 that branches away from the heat pump circuit 25. This connection 43 has a threaded end, which in the illustrated state is plugged. However, in case of malfunction of the temperature 39 or pressure 35 sensor (cf. FIG. 4) in this part of the circuit, the threaded connection can be used to fit a replacement sensor, which allows for simplified maintenance. The temperature and pressure sensors that the heat pump circuit is originally provided with may be built into the circuit and the malfunctioning sensor may remain at its location while its leads are instead connected to the replacement sensor. Such a threaded connection can be useful also in tumble dryers with other drum configurations, such as tumble dryers with a drum outlet arranged at the tumble dryer door.

Switching circuits of the inverter 29 that controls the compressor motor 27 (cf. FIG. 4) produce heat that need be dissipated to ensure proper function. This also applies to other electronics of the tumble dryer, such as for instance electronics of the control unit 31. Normally, this would be done simply by connecting the electronics to a heat sink, dissipating the heat to the ambient space. The present disclosure suggests using a heat pump flow to improve this cooling. This provides very efficient cooling of inverter and optionally other electronics and may additionally improve the energy efficiency of the tumble dryer as a whole. The heat pump flow may be the flow of the heat pump's refrigerant, or the flow of air dried by the heat pump.

Figure 7:
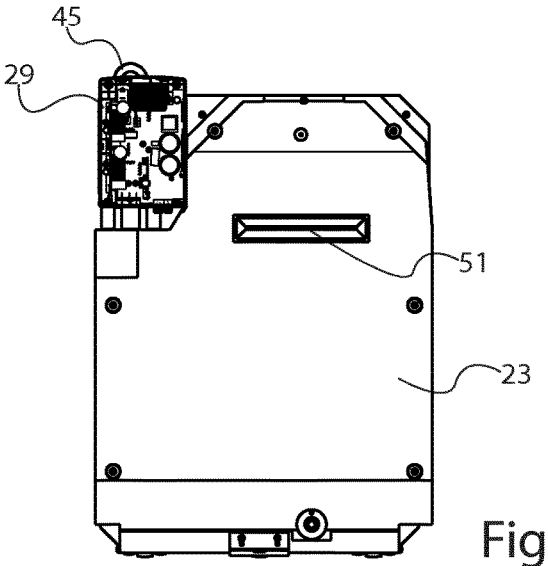
FIG. 7-10 show a first example of a heat pump flow cooled inverter.
Figure 8:
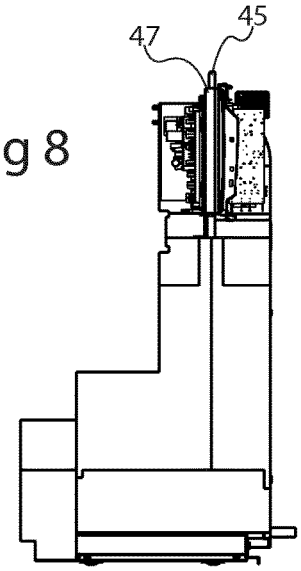

FIG. 7-10 show a first example of a heat pump flow cooled inverter. In this case, a suction line 45 for leading refrigerant in the heat pump circuit from the evaporator 15 to the compressor 17 is used to cool the electronics, as shown in FIG. 7 illustrating the heat pump arrangement as seen from the rear of the tumble dryer. This suction line 45 is led out of the insulating shell 23 to provide an external loop. The electronics may be attached to a heat sink block 47 through which the suction line 45 passes. Electronics to be cooled may be located on both sides of the heat sink block 47 as best seen in the side view of FIG. 8.

Figure 9:
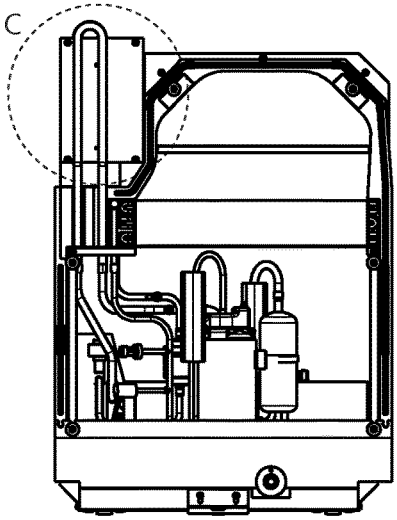
Figure 10:
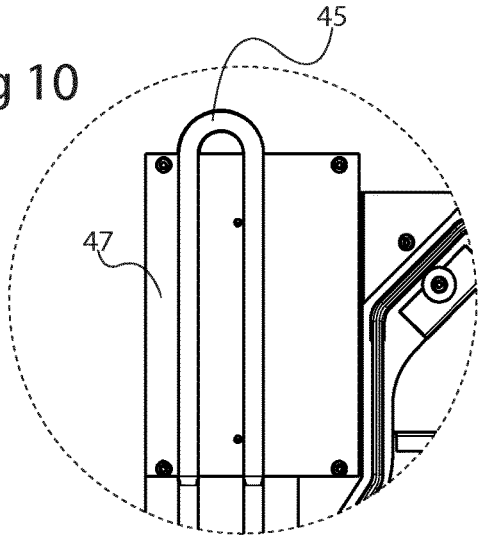

FIG. 9 shows the same view as in FIG. 7 with the suction line 45 exposed, and FIG. 10 illustrates enlarged the portion C of FIG. 9. With reference to FIG. 10, the heat sink block 47 may comprise two halves that are fitted to enclose the suction line loop 45. A groove suitable to enclose a part of the suction line may be machined into the heat sink block 47 halves, which may be a solid metal blocks, for instance made of aluminum. It is possible to provide a heat transferring paste in the grooves to increase heat conduction from the heat sink although this is not necessary. In this way, very effective transfer of heat from the heat sink block 47 to the suction line 45 takes place, and the electronics becomes very efficiently cooled. Additionally, the cool refrigerant flow in the suction line becomes heated before reaching the compressor, which improves the heat pump efficiency further.

Figure 11:
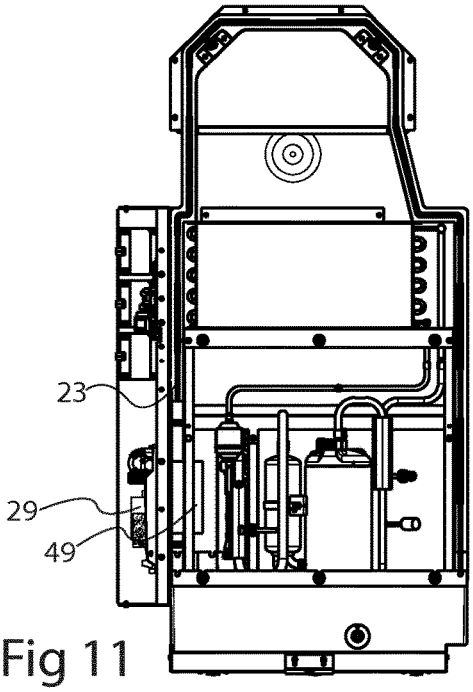
FIG. 11 shows a second example of a heat pump flow cooled inverter.

FIG. 11 shows an alternative for cooling an inverter with a heat pump flow. In FIG. 11, the rear wall of the insulating shell has been taken away to expose the interior of the heat pump arrangement. In this example, the inverter 29 electronics is attached to a heat sink block 49 which reaches through a wall of the insulating shell 23. This allows the other end of the heat sink 49 to reach into the process air stream 21 inside the shell. Typically, the heat sink projects into the air stream between the evaporator and the compressor, i.e. in the cooler portion of the stream path. This as well provides efficient cooling of the inverter electronics and recycling of heat that would otherwise be lost in the tumble dryer. The inverter 29 electronics may be placed outside the shell 23 where humidity is lower.

It should be noted that the cooling arrangements illustrated in FIGS. 7-11 may be useful also in tumble dryers with other drum configurations, such as tumble dryers with a drum outlet arranged at the tumble dryer door.

Returning to FIG. 7, there is shown an opening 51 in the outer shell 23. This opening 51 is located above the condenser 19 and connects the process air path 21 to the ambient space outside the shell 23 at this location. This means that any overpressure in the air flow reaching the drum 11 can be reduced, which is useful, since such overpressure could otherwise force humid air into devices, e.g. ball bearings or electronics, that should preferably be kept dry. As illustrated in FIG. 2, a corresponding opening 60 may be provided in the outer housing 2 to let the hot air out of the tumble dryer.

Figure 12:
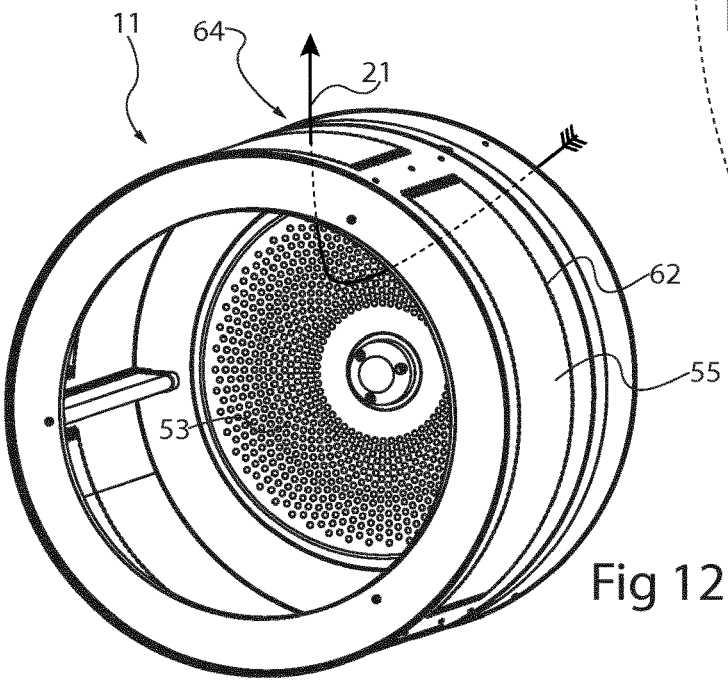
FIG. 12 shows a tumble dryer drum.

FIG. 12 shows a tumble dryer drum 11. The drum has a circular rear wall 53 with air inlet openings and a radial cylindrical wall 55 with air outlet openings in the indicated area 62. This area may comprise a large number of openings/holes, together providing a significant outlet. It may be advantageous to locate the openings of the cylindrical part in the front part of the drum such that the air flow passes most of the drum's 11 space. However, as no outlet connected to the tumble dryer door 5 (cf. FIG. 1) is needed, it is possible to run the air flow 21 through the drum 11 even if the door is temporarily opened. If for instance the user adds additional wet laundry to the drum 11 or withdraws laundry therefrom, the processes can be kept running, although suitably at a lower level. This reduces the number of starts/stops of the compressor and may improve its durability. When the door has been opened a predetermined period of time, the heat pump is switched off.

With a tumble dryer drum 11 flow that passes from rear inlet to outlets located in the outer cylindrical periphery of the drum, a filter 12 (cf. FIG. 2) may be placed under the drum, and may take up a large part of the area between the drum and the filter arrangement. This allows the use of a large, high-capacity filter, and high process air flows. Further, as air is let out of the drum 11 through a considerable flow area comprised by the openings in the outlet area 62, flow restriction can be reduced, as compared to where openings are arranged at the door. Additionally, the space outside the drum's cylindrical periphery almost as a whole can be used as a duct leading down to the lint filter under the drum 11. In this way, the flow through the drum can be increased which is particularly useful in a high-capacity heat pump tumble dryer.

It may be preferred to locate 90% or more of the outlet openings to the front half of the cylindrical portion of the drum.

Figure 13:
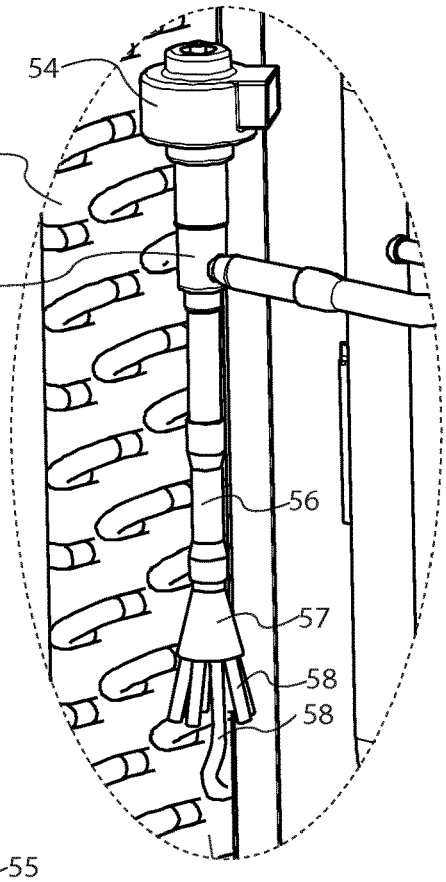
FIG. 13 shows an enlarged portion B of FIG. 3.

FIG. 13 shows an enlarged portion B of FIG. 3. There is shown a flow divider 57 that splits the refrigerant flow from the expansion valve 16 into a number of sub-flows 58 that are passed to different portions of the evaporator. As shown, the controllable expansion valve 16, controlled electronically by means of a solenoid 54, is connected to the flow divider 57 by means of a straight conduit 56. This means that a less disturbed, more laminar flow will reach the divider 57. As a result, the flow is more evenly divided between the sub-flows 58 that reach different parts of the evaporator 15. It may be preferred that the conduit 56 is short, e.g. shorter than 100 mm to improve this effect further.

The present disclosure is not restricted to the above-described embodiment, and may be varied and altered in different ways within the scope of the appended claims.

The invention claimed is:

1. Tumble dryer comprising a housing, a drum in the housing accessible from a front side of the housing and rotatable about its center axis, a fan arrangement for producing a flow of process air passing through the drum, and a heat pump for drying the process air before entering the drum, the heat pump comprising a compressor, a condenser, an expansion valve, and an evaporator forming a refrigerant fluid loop, wherein:

the rotatable drum comprises a circular rear wall with air inlet openings and a radial cylindrical wall with air outlet openings, the compressor is adapted to be run by an inverter, allowing the compressor output to be varied, the expansion valve is controllable, and the expansion valve and the compressor are controlled by a controller based on data from at least one sensor, wherein the at least one sensor comprises one or more of a first pressure sensor, a second pressure sensor, a first temperature sensor, and a second temperature sensor, wherein the first pressure sensor and the first temperature sensor are located in the refrigerant fluid flow from the expansion valve to the compressor, and the second pressure sensor and the second temperature sensor are located in the refrigerant fluid flow from the compressor to the expansion valve.

2. Tumble dryer according to claim 1, wherein the evaporator comprises a flow divider, dividing a refrigerant fluid flow into a plurality of sub-flows for different portions of the evaporator, and wherein the controllable expansion valve is attached to the flow divider.

3. Tumble dryer according to claim 2, wherein a conduit between the expansion valve and the flow divider is straight.

4. Tumble dryer according to claim 2, wherein a length of a conduit between the expansion valve and the flow divider is less than 100 mm.

5. Tumble dryer according to claim 1, comprising at least one threaded connection adapted to receive a replacement sensor in either of a heat pump circuit path from the expansion valve to the compressor, or from the compressor to the expansion valve, or both.

6. Tumble dryer according to claim 1, wherein the inverter comprises a heat sink cooled by heat pump flow.

7. Tumble dryer according to claim 6, wherein the heat sink is cooled by a suction line between the evaporator and the compressor.

8. Tumble dryer according to claim 7, wherein a loop of the suction line is embedded in the heat sink.

9. Tumble dryer according to claim 7, wherein a heat pump circuit is enclosed in an insulating shell, and the suction line reaches out of the insulating shell to reach the heat sink.

10. Tumble dryer according to claim 6, wherein the heat sink is cooled by process air flow leaving the evaporator.

11. Tumble dryer according to claim 10, wherein a heat pump circuit is enclosed in an insulating shell and the heat sink is partly located inside the insulating shell.

12. Tumble dryer according to claim 11, wherein electronics of the inverter are located outside the insulating shell.

13. Tumble dryer according to claim 1, wherein an inner of the drum is accessible through a door, and wherein control of the compressor is adapted such that opening of said door changes refrigerant flow while the refrigerant flow remains switched on.

14. Tumble dryer according to claim 13, wherein the refrigerant flow is reduced to 30- 60% of the flow before the door was opened.

15. Tumble dryer according to claim 14, wherein the compressor is subsequently switched off if the door remains open a predetermined time.

16. Tumble dryer according to claim 1, wherein the heat pump is enclosed in an insulating shell and there is provided an opening in said insulating shell between the condenser and the air inlet openings of the drum.

17. Tumble dryer according to claim 16, wherein there is provided a corresponding opening in the housing.

18. Tumble dryer according to claim 1, wherein a space outside the drum's cylindrical periphery is configured as a duct leading to a filter.

19. Tumble dryer according to claim 1, wherein a filter is placed below the drum.

* * * * *